US009851133B2

(12) United States Patent
Nakaguchi et al.

(10) Patent No.: US 9,851,133 B2
(45) Date of Patent: Dec. 26, 2017

(54) REFRIGERATION CYCLE APPARATUS

(71) Applicant: Toshiba Carrier Corporation, Kanagawa (JP)

(72) Inventors: Kentaro Nakaguchi, Fuji (JP); Yukio Kiguchi, Fuji (JP); Hideaki Suzuki, Fuji (JP); Ryouhei Kamiya, Fuji (JP)

(73) Assignee: TOSHIBA CARRIER CORPORATION, Kawasaki-shi, Kanagawa (JP)

( * ) Notice: Subject to any disclaimer, the term of this patent is extended or adjusted under 35 U.S.C. 154(b) by 314 days.

(21) Appl. No.: 14/693,437

(22) Filed: Apr. 22, 2015

(65) Prior Publication Data

US 2015/0300701 A1 Oct. 22, 2015

(30) Foreign Application Priority Data

Apr. 22, 2014 (JP) ..... 2014-087921

(51) Int. Cl.
*F25B 49/00* (2006.01)

(52) U.S. Cl.
CPC ..... *F25B 49/005* (2013.01); *F25B 2500/08* (2013.01)

(58) Field of Classification Search
CPC ... F25B 43/006; F25B 49/005; F25B 2400/03
See application file for complete search history.

(56) References Cited

U.S. PATENT DOCUMENTS 3,578,896 A * 5/1971 Lynch ..... H01R 4/58 156/49
3,754,409 A * 8/1973 Wreen, Jr. ..... F25B 43/006 62/503
4,718,250 A * 1/1988 Warren ..... F25B 43/006 62/278
5,845,502 A * 12/1998 Chen ..... F25B 47/025 62/156
6,253,572 B1 * 7/2001 Bottum, Sr. ..... F25B 43/006 62/509

(Continued)

FOREIGN PATENT DOCUMENTS

JP 55-178678 12/1980
JP 57-188076 11/1982

(Continued)

OTHER PUBLICATIONS

Jun. 27, 2017 Japanese official action (including English translation) in connection with corresponding Japanese patent appication No. 2014-087921.

*Primary Examiner* — Marc Norman
(74) *Attorney, Agent, or Firm* — John P. White; Cooper & Dunham LLP

(57) ABSTRACT

According to one embodiment, a refrigeration cycle apparatus, a fusible plug is attached to a low-pressure-side pipe between an evaporator and a compressor. The refrigeration cycle apparatus includes a heat quantity reduction member. The fusible plug fuses when a temperature of heat transmitted from the low-pressure-side pipe to the fusible plug reaches a predetermined value or more, and then opens the inside of the low-pressure-side pipe to atmosphere. The heat quantity reduction member reduces the quantity of heat to be transmitted to the fusible plug.

10 Claims, 3 Drawing Sheets

(56) References Cited

U.S. PATENT DOCUMENTS

| | | | | |
|---|---|---|---|---|
| 6,321,544 | B1 * | 11/2001 | Kanai | F04C 28/06 62/126 |
| 2009/0148338 | A1 * | 6/2009 | Kato | C22C 28/00 420/555 |

FOREIGN PATENT DOCUMENTS

| | | | |
|---|---|---|---|
| JP | 63-196063 | | 12/1988 |
| JP | 64-23073 | | 1/1989 |
| JP | 2013-228129 | A | 11/2013 |

* cited by examiner

REFRIGERATION CYCLE APPARATUS

CROSS-REFERENCE TO RELATED APPLICATIONS

This application is based upon and claims the benefit of priority from Japanese Patent Application No. 2014-087921, filed Apr. 22, 2014, the entire contents of which are incorporated herein by reference.

FIELD

Embodiments described herein relate generally to a refrigeration cycle apparatus which includes an accumulator, and a fusible plug is attached to a low-pressure-side pipe connected to the accumulator.

BACKGROUND

A refrigeration cycle apparatus is known in which a compressor, a condenser, a pressure reducing unit and an evaporator are connected to each other by pipes, and an accumulator and a fusing plug are provided at a low-pressure-side pipe between the evaporator and the compressor (Jpn. Pat. Appln. KOKAI Publication No. 2013-228129).

The fusible plug is provided to prevent the internal temperature and pressure of the accumulator from rising to high values because of an abnormal rise of atmospheric temperature which is caused by, for example, a fire, to thereby prevent the accumulator from being broken. When a detected temperature reaches a predetermined value, the fusible plug fuses to open the low-pressure-side pipe or the accumulator to the atmosphere. As a result, a high-pressure gas in the accumulator flows out therefrom to the outside, thus preventing the accumulator from being broken.

In a heat-pump-type refrigeration cycle apparatus which can perform heating, during heating, frost gradually adheres to a surface of an outdoor heat exchanger functioning as an evaporator, and a heat-exchange efficiency of the outdoor heat exchanger decreases if no countermeasures are taken. In view of this, in the heat-pump-type refrigeration cycle apparatus, if frost adheres to the outdoor heat exchanger, a so-called reverse-cycle defrosting operation is performed. In this defrosting operation, the flowing direction of refrigerant is reversed, and refrigerant discharged from the compressor is directly supplied to the outdoor heat exchanger.

However, if the reverse-cycle defrosting operation is performed, a low-pressure gas refrigerant flows into a pipe in which a high-pressure gas refrigerant flows to increase the temperature of the pipe to a high level. While the low-pressure gas refrigerant is absorbing heat of the pipe having a high temperature, its temperature of the low-pressure gas refrigerant rises to a high temperature. The low-pressure gas refrigerant having a high temperature flows into the low-pressure-side pipe. At this time, heat of the refrigerant flowing into the low-pressure-side pipe is transmitted to the fusible plug. Thus, although the inner pressure of the accumulator is not abnormal, there is a possibility that the fusible plug will fuse.

DETAILED DESCRIPTION

In general, according to one embodiment, a refrigeration cycle apparatus includes:

a refrigeration cycle in which a compressor, a condenser, a pressure reducing unit and an evaporator are connected to each other by pipes, and an accumulator is provided at a low-pressure-side pipe between the evaporator and the compressor;

a fusible plug attached to the low-pressure-side pipe; and a heat-quantity reduction member which reduces quantity of heat to be transmitted to the fusible plug.

[1] First Embodiment

Figure 1:
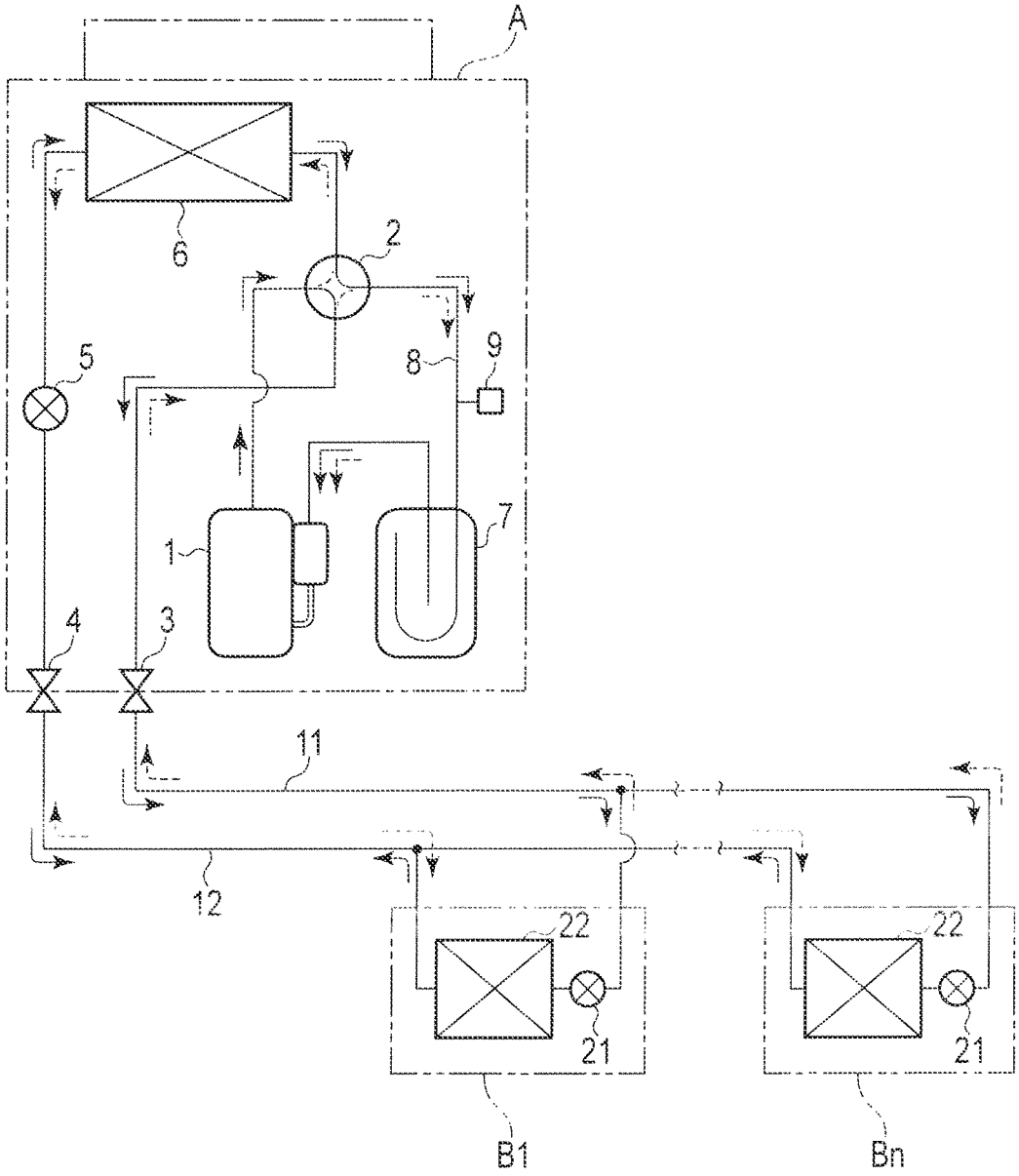
FIG. 1 is a view showing a configuration of a heat-pump-type refrigeration cycle in each of embodiments.

The first embodiment will be explained with reference to the accompanying drawings. FIG. 1 shows a heat-pump-type refrigeration cycle of an air conditioner.

A packed valve 3 is connected to a discharge port of a compressor 1 by a pipe, with a four-way valve 2 interposed between the packed valve 3 and the compressor 1. Also, ends of a plurality of indoor heat exchangers 22 are connected to the packed valve 3 by pipes on their one side, with a gas-side pipe 11 and flow regulating valves 21 interposed between the indoor heat exchangers 22 and the packed valve 3. The other ends of the indoor heat exchangers 22 are connected to a packed valve 4, with a liquid-side pipe 12 interposed between the indoor heat exchangers 22 and the packed valve 4. Also, the packed valve 4 is connected to one of ends of an outdoor heat exchanger 6 by a pipe, with an expansion valve 5 interposed between the packed valve 4 and the outdoor heat exchanger 6. The other end of the outdoor heat exchanger 6 is connected to an intake of the compressor 1 by a pipe, with the four-way valve 2 and an accumulator 7 interposed between the outdoor heat exchanger 6 and the compressor 1. Furthermore, a fusible plug 9 is attached to a low-pressure-side pipe 8 between the four-way valve 2 and the accumulator 7.

The compressor 1, the four-way valve 2, the packed valves 3 and 4, the expansion valve 5, the outdoor heat exchanger 6, the accumulator 7, the low-pressure-side pipe 8 and the fusible plug 9 are provided in an outdoor unit A. The flow regulating valves 21 are provided in indoor units B1 to Bn, respectively, and the indoor heat exchangers 22 are also in the indoor units B1 to Bn, respectively.

Figure 2:
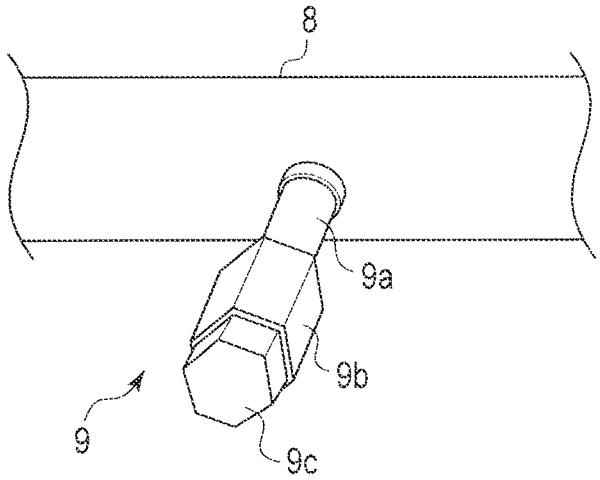
FIG. 2 is a perspective view showing a fusible plug in each of the embodiments.

As shown in FIG. 2, the fusible plug 9 includes: a pipe-like portion 9*a* inserted in a pipe wall of the low-pressure-side pipe 8 to communicate with an internal space of the low-pressure-side pipe 8; an annular portion 9*b* provided at a peripheral edge of a distal end opening of the pipe-like portion 9*a*; and a fusible metallic plug portion 9*c* plugged in an internal opening of the annular portion 9*b* to close the distal end opening of the pipe-like portion 9*a*.

If the temperature and pressure of the inside of the accumulator 7 both rise to high levels, and the temperature of the low-pressure-side pipe 8 also rises, heat generated by the rising temperature of the low-pressure-side pipe 8 is transmitted to the fusible plug 9. The metallic plug portion 9*c* fuses when a detected temperature reaches a predetermined value (melting point). When the metallic plug portion 9*c* fuses, the inside of the low-pressure-side pipe 8 is opened to the atmosphere through the fusible plug 9. As a result, a high-temperature, high-pressure gas in the accumulator 7 flows out therefrom to the outside through the low-pressure-side pipe 8 and the fusible plug 9.

Figure 3:
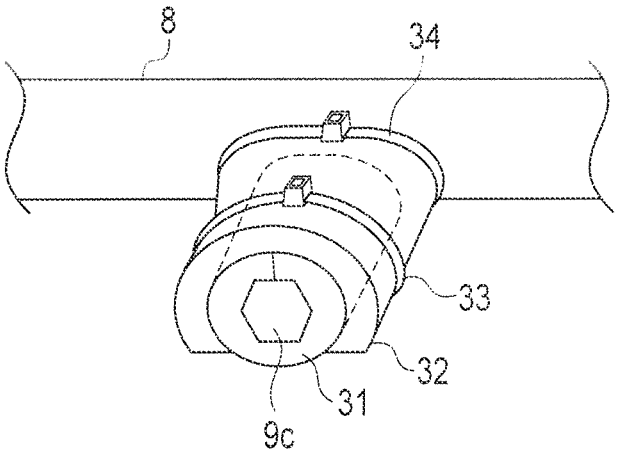
FIG. 3 is a perspective view showing a fixed state of endothermic members in a first embodiment.

After the fusible plug 9 is fixed to the low-pressure-side pipe 8, as shown in FIG. 3, for example, a sheet-like endothermic member (first endothermic member) 31, which is a heat-quantity reduction member, is wound on the pipe-like portion 9*a* and the annular portion 9*b* of the fusible plug 9. The endothermic member 31 covers the pipe-like portion 9*a* and the annular portion 9*b*, and one end portion of the endothermic member 31 (which is an end portion thereof in an axial direction of the fusible plug 9) is in contact with a peripheral surface of the low-pressure-side pipe 8. The metallic plug portion 9*c* of the fusible plug 9 is not covered, and thus exposed to the atmosphere.

After the endothermic member 31 is wound on the fusible plug 9, a sheet-like endothermic member (second endothermic member) 32, which is another heat-quantity reduction member, is also wound on the endothermic member 31. One end portion of the endothermic member 32 (which is an end portion thereof in the axial direction of the fusible plug 9) is also in contact with the peripheral surface of the low-pressure-side pipe 8.

After the endothermic members 31 and 32 are wound in the above manner, elastic bands 33 and 34 are wound and tightened on the endothermic member 32. As a result, the endothermic members 31 and 32 are fixed to the fusible plug 9. The fixed endothermic members 31 and 32 cover the pipe-like portion 9*a* and the annular portion 9*b*, but do not cover the metallic plug portion 9*c*.

The endothermic members 31 and 32 are formed of, for example, butyl rubber, which is a combination of isobutylene and isoprene, and absorbs heat. The endothermic members 31 and 32 are wound on the pipe-like portion 9*a* and the annular portion 9*b* of the fusible plug 9, to thereby reduce the quantity of heat to be transmitted from the low-pressure-side pipe 8 to the metallic plug portion 9*c* of the fusible plug 9.

The quantity of heat to be transmitted from the low-pressure-side pipe 8 to the metallic plug portion 9*c* of the fusible plug 9 can be increased or decreased to an optimal value by adjusting the thicknesses and areas of the endothermic members 31 and 32 and also changing the number of circles in which the endothermic members 31 and 32 are wound.

Next, the operation and advantage of the heat-pump-type refrigeration cycle and the operation of the fusible plug 9 will be explained.

During heating, as indicated by solid arrows in FIG. 1, a gas refrigerant discharged from the compressor 1 passes through the four-way valve 2, the packed valve 3, the gas-side pipe 11 and the flow regulating valves 21, and then flows into the indoor heat exchangers (condensers) 22. The refrigerant flowing into each of the indoor heat exchangers 22 radiates heat to indoor air, and then condenses. A liquid refrigerant flowing out from each indoor heat exchanger 22 passes through the liquid-side pipe 12, the packed valve 4 and the expansion valve 5, and then flows into the outdoor heat exchanger (evaporator) 6. The refrigerant flowing in the outdoor heat exchanger 6 takes heat from outside air to evaporate. Then, a gas refrigerant flowing out from the outdoor heat exchanger 6 passes through the four-way valve 2, the low-pressure-side pipe 8 and the accumulator 7, and is sucked to the compressor 1.

During air-cooling, as indicated by a dashed arrow, the gas refrigerant discharged from the compressor 1 flows into the outdoor heat exchanger (condenser) 6 through the four-way valve 2. The refrigerant flowing in the outdoor heat exchanger 6 radiates heat to outside air and condenses. A liquid refrigerant flowing out from the outdoor heat exchanger 6 passes through the expansion valve 5, the packed valve 4, the packed valve 3 and the liquid-side pipe 12, and flows into the indoor heat exchangers (evaporators) 22. The liquid refrigerant flowing in each of the indoor heat exchangers 22 takes heat from indoor air and evaporates. A gas refrigerant flowing out from each of the indoor heat exchangers 22 passes through the gas-side pipe 11, the packed valve 3, the four-way valve 2, the low-pressure-side pipe 8 and the accumulator 7, and is sucked to the compressor 1.

Furthermore, during heating, frost gradually adheres to a surface of the outdoor heat exchanger 6 serving as the evaporator, and the heat-exchange efficiency of the outdoor heat exchanger 6 decreases if no countermeasures are taken. In view of this point, formation of frost on the outdoor heat exchanger 6 is monitored based on the temperature of the outdoor heat exchanger 6. If the amount of frost forming on the outdoor heat exchanger 6 reaches a predetermined value or more, a flow path to be set by the four-way valve 2 is switched, and a reverse-cycle defrosting operation is performed in which refrigerant flows in a direction indicated by dashed arrows. To be more specific, a gas refrigerant having a high temperature, which is discharged from the compressor 1, passes through the four-way valve 2, and then directly flows into the outdoor heat exchanger 6, as a result of which the frost on the outdoor heat exchanger 6 thaws because the gas refrigerant has a high temperature. If the temperature of the outdoor heat exchanger 6 rises because of the frost thawing, the reverse-cycle defrosting operation is stopped, and an ordinary heating operation is restarted.

Where in the gas-side pipe 11, a high-pressure gas refrigerant flows to cause the gas-side pipe 11 to have a high temperature (for example, 105° C.), when the reverse cycle operation is started by switching the flow path to be set by the four-way valve 2, a low-pressure gas flows into the gas-side pipe 11 having the high temperature. The low-pressure gas refrigerant flowing in the gas-side pipe 11 absorbs heat of the gas-side pipe 11 having the high temperature, and thus its temperature rises to the high level. The gas refrigerant then passes through the packed valve 3 and the four-way valve 2 to flow into the low-pressure-side pipe 8. As a result, the temperature of the low-pressure-side pipe 8 rises to, for example, approximately 72° C. due to the gas refrigerant whose temperature rises to a high level. If heat of the low-pressure-side pipe 8 is transmitted to the metallic plug portion 9*c* of the fusible plug 9 without taking countermeasures, there is a possibility that the metallic plug portion 9*c* will fuse, although the internal pressure of the accumulator 7 does not abnormally rise.

It should be noted that the longer the gas-side pipe 11, the larger the quantity of heat absorbed by the low-pressure gas, and the greater the degree to the temperature of the low-pressure-side pipe 8 rises.

However, the quality of heat transmitted from the low-pressure-side pipe 8 to the metallic plug portion 9*c* of the fusible plug 9 is reduced by a heat absorbing action of the endothermic members 31 and 32 wound on the fusible plug 9. Therefore, even if the temperature of the low-pressure-side pipe 8 rises at the time of starting the reverse-cycle defrosting operation, the metallic plug portion 9*c* does not fuse. It is therefore possible to prevent the metallic plug portion 9*c* from unnecessarily fusing.

On the other hand, if an ambient atmospheric temperature of the accumulator 7 abnormally rises, or an internal pressure of the accumulator 7 abnormally rises, the temperature of the low-pressure-side pipe 8 more greatly rises than at the time of staring the reverse-cycle defrosting operation. Thus, regardless of the heat absorbing action of the endothermic members 31 and 32, the temperature of the metallic plug portion 9*c* reaches a predetermined value (melting point), and thus the metallic plug portion 9*c* fuses. Due to fusing of the metallic plug portion 9*c*, the inside of the low-pressure-side pipe 8 is opened to the atmosphere through the fusible plug 9. Therefore, a high-temperature, high-pressure gas in the accumulator 7 flows out therefrom to the outside through the low-pressure-side pipe 8 and the fusible plug 9, thus preventing the accumulator 7 from being broken.

The thickness, the area of each of the endothermic members 31 and 32 and the number of circles in which each endothermic member is wound are set to optimal values ascertained in advance by an experiment, so that the metallic plug portion 9*c* reliably fuses when the ambient atmospheric temperature of the accumulator 7 abnormally rises or the internal pressure of the accumulator 7 abnormally rises, and the metallic plug portion 9*c* does not fuse even when the temperature of the low-pressure-side pipe 8 rises at the time of starting the reverse-cycle defrosting operation.

[2] Second Embodiment

Figure 4:
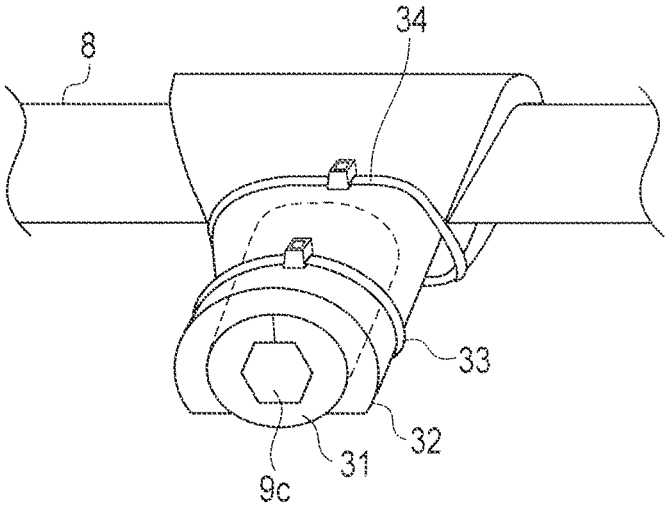
FIG. 4 is a perspective view showing a fixed state of endothermic members in a second embodiment.

In the second embodiment, as shown in FIG. 4, of the endothermic members 31 and 32 wound on the fusible plug 9, an upper one, i.e., the endothermic member 32, has an end portion (in the axial direction of the fusible plug) which is extended toward the low-pressure-side pipe 8 and wound thereon.

Then, the bands 33 and 34 are wound and tightened on the endothermic member 32. Also, when the band 34 is tightened, a distal end of the end portion of the low-pressure-side pipe 8, which is wound in a single circle with the endothermic member 32, is bound by the band 34. Due to winding and tightening of the bands 33 and 34, the endothermic members 31 and 32 are firmly fixed to the fusible plug 9 and the low-pressure-side pipe 8.

The other structural features of the second embodiment are the same as those of the first embodiment.

The end portion of the endothermic member 32 is also wound on the low-pressure-side pipe 8. Thus, the endothermic members 31 and 32 function not only as heat-quantity reduction members, but as shock-absorbing members which absorb vibration created in an operation or movement such as transport of the outdoor unit A. In such a manner, since vibration is absorbed, it is possible to prevent a fatigue breaking of an attachment portion of the fusible plug 9. The other advantages of the second advantage are the same as those of the first embodiment.

[3] Third Embodiment

Figure 5:
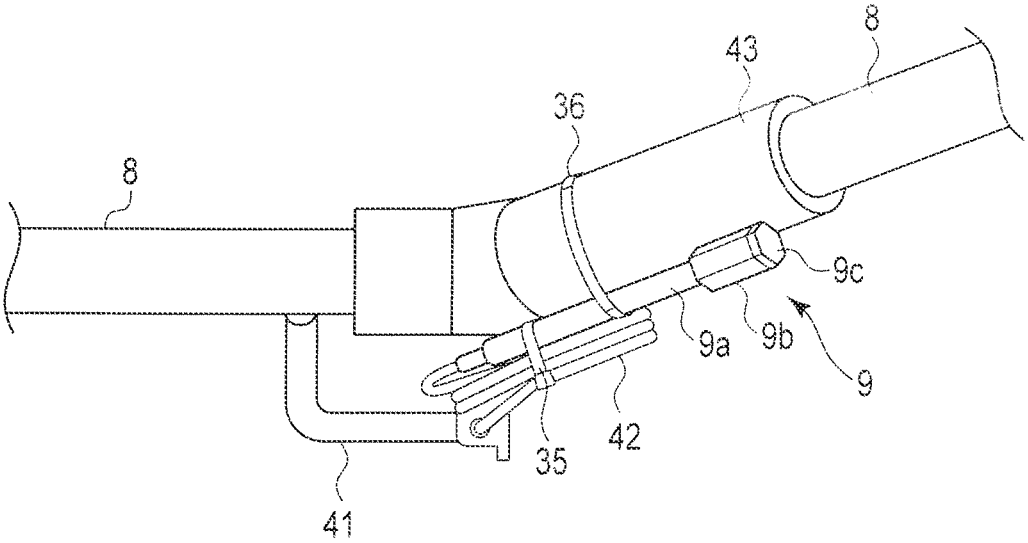
FIG. 5 is a perspective view showing a fixed state of a capillary tube in a third embodiment.

In the third embodiment, as shown in FIG. 5, an end portion of an L-shaped pipe 41 is inserted in a pipe wall of the low-pressure-side pipe 8 to communicate with an internal space of the low-pressure-side pipe 8. Also, to another end portion of the pipe 41, an end portion of, e.g., the capillary tube (thermal resistance member) 42, which is a heat-quantity reduction member, is connected. To another end portion of the capillary tube 42, the pipe-like portion 9*a* of the fusible plug 9 is connected.

In general, a capillary tube is a small tube wound in circles, and used as a pressure reducing mechanism for a refrigeration cycle. In the third embodiment, the capillary tube 42 is provided between the low-pressure-side pipe 8 and the fusible plug 9, to thereby reduce the quantity of heat to be transmitted from the low-pressure-side pipe 8 to the fusible plug 9.

It should be noted that the capillary tube 42 is located along the pipe-like portion 9*a* of the fusible plug 9. Furthermore, a band (first band) 35 is wound and tightened on the capillary tube 42 and the pipe-like portion 9*a*. Due to this tightening of the band 35, the capillary tube 42 and the pipe-like portion 9*a* of the fusible plug 9 are bound together.

Furthermore, an adiathermanous tube 43 is provided on an outer peripheral surface of the low-pressure-side pipe 8, and the pipe-like portion 9*a* of the fusible plug 9 is provided on an outer peripheral surface of the adiathermanous tube 43. Then, a band (second band) 36 is wound and tightened on the adiathermanous tube 43 and the pipe-like portion 9*a* of the fusible plug 9. Due to tightening of the band 36, the pipe-like portion 9*a* and the adiathermanous tube 43 are bound together, and also the capillary tube 42 and the fusible plug 9 are held on the low-pressure-side pipe B.

The other structural features of the third embodiment are the same as those of the first embodiment.

Where in the gas-side pipe 11, a high-pressure gas flows to cause the gas-side pipe 11 to have a high temperature (e.g., 105° C.), when the reverse-cycle defrosting operation is started by switching the flow path to be set by the four-way valve 2, a low-pressure gas refrigerant flows into the gas-side pipe 11 having the high temperature. The low-pressure gas refrigerant flowing into the gas-side pipe 11 absorbs heat of the gas-side pipe 11 having the high temperature, and its temperature thus rises to a high level. It then passes through the packed valve 3 and the four-way valve 2, and flows into the low-pressure-side pipe 8. Because the gas refrigerant has a high temperature, the temperature of the low-pressure-side pipe 8 rises.

At this time, the quantity of heat transmitted from the low-pressure-side pipe 8 to the fusing plug 9 through the pipe 41 and the capillary tube 42 is reduced by a thermal resistance action of the capillary tube 42. Also, heat to be directly transmitted from the outer peripheral surface of the low-pressure-side pipe 8 to the fusible plug 9 is shut out by the adiathermanous tube 43.

Therefore, at the time of starting the reverse-cycle defrosting operation, even if the temperature of the low-pressure-side pipe 8 rises, the metallic plug portion 9*c* does not fuse. Thus, the metallic plug portion 9*c* is prevented from unnecessarily fusing.

On the other hand, when the ambient atmospheric temperature of the accumulator 7 rises abnormally or the internal pressure of the accumulator 7 abnormally rises, the temperature of the low-pressure-side pipe 8 more greatly rises than at the time of starting the reverse-cycle defrosting operation. Thus, regardless of the thermal resistance action of the capillary tube 42, the temperature of the metallic plug portion 9*c* reaches a predetermined value (melting point), and the metallic plug portion 9*c* fuses. Because of the fusing of the metallic plug portion 9*c*, the inside of the low-pressure-side pipe 8 is opened to the atmosphere through the pipe 41, the capillary tube 42 and the fusible plug 9. Therefore, a high-pressure and high-temperature gas in the accumulator 7 flows out therefrom to the outside through the low-pressure-side pipe 8, the pipe 41, the capillary tube 42 and the fusible plug 9. Thus, the accumulator 7 is prevented from being broken.

The thickness and length of the capillary tube 42 are set to optimal values ascertained in advance by an experiment, so that the metallic plug portion 9*c* reliably fuses when the ambient atmospheric temperature of the accumulator 7 rises abnormally or the internal pressure of the accumulator 7 rises abnormally, and the metallic plug portion 9*c* does not fuse even when the temperature of the low-pressure-side pipe 8 rises at the time of starting the reverse-cycle defrosting operation.

Modifications

In the explanations of the above embodiments, the refrigeration cycle apparatus provided in the air conditioner is referred to by way of example. However, the embodiments can also be applied to a refrigeration cycle apparatus provided in another apparatus such as a hot-water supply apparatus.

Also, in each of the above embodiments, as the heat-quality reduction members, the sheet-like endothermic members 31 and 32 and the capillary tube 42 are applied; however, another member may be applied as long as it has a heat-quantity reduction function.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A refrigeration cycle apparatus comprising:

a refrigeration cycle in which a compressor, a condenser, a pressure reducing unit and an evaporator are connected to each other by pipes, and an accumulator is provided at a low-pressure-side pipe between the evaporator and the compressor;

a fusible plug attached to the low-pressure-side pipe; and a heat-quantity reduction member which reduces quantity of heat to be transmitted to the fusible plug, the heat-quantity reduction member being one or more sheet-like endothermic members which are wound on the fusible plug.

2. The apparatus of claim 1, wherein the refrigeration cycle is a heat-pump-type refrigeration cycle, and has a function of performing a defrosting operation of clearing frost adhering to the evaporator.

3. The apparatus of claim 1, further comprising:

one or more bands wound on the one or more endothermic members to fix the one or more endothermic members to the fusible plug.

4. The apparatus of claim 1, wherein the fusible plug includes a pipe-like portion inserted in a pipe wall of the low-pressure-side pipe to communicate with an internal space of the low-pressure-side pipe, an annular portion provided at a peripheral edge of a distal end opening of the pipe-like portion, and a fusible metallic plug portion plugged in an internal opening of the annular portion to close the distal end opening of the pipe-like portion.

5. The apparatus of claim 4, wherein the one or more endothermic members include a first sheet-like endothermic member wound on the pipe-like portion and the annular portion of the fusible plug, and a second sheet-like endothermic member wound on the first sheet like endothermic member.

6. The apparatus of claim 5, further comprising:

one or more bands wound on the second sheet-like endothermic member to fix the first and second sheet-like endothermic members to the fusible plug.

7. The apparatus of claim 5, wherein the second sheet-like endothermic member is wound on the first sheet-like endothermic member, and also on the low-pressure-side pipe.

8. A refrigeration cycle apparatus comprising:

a refrigeration cycle in which a compressor, a condenser, a pressure reducing unit and an evaporator are connected to each other by pipes, and an accumulator is provided at a low-pressure-side pipe between the evaporator and the compressor;

a fusible plug attached to the low-pressure-side pipe; and a heat-quantity reduction member which reduces quantity of heat to be transmitted to the fusible plug, the heat-quantity reduction member being a capillary tube provided between the low-pressure-side pipe and the fusible plug, the refrigeration cycle apparatus further comprising:

a first band which binds the fusible plug and the capillary tube together; and an adiathermanous tube provided on an outer peripheral surface of the low-pressure-side pipe; and a second band which binds the fusible plug and the a diathermanous tube together.

9. The apparatus of claim 8, further comprising:

a pipe inserted in a pipe wall of the low-pressure-side pipe to communicate with an internal space of the low-pressure-side pipe, wherein the capillary tube includes an end portion connected to the pipe, and another end portion connected to the fusible plug, and the fusible plug includes a pipe-like portion connected to the other end portion of the capillary tube, an annular portion provided at a peripheral edge of a distal end opening of the pipe-like portion, and a fusible metallic plug portion plugged in an internal opening of the annular portion to close to the distal end opening of the pipe-like portion.

10. The apparatus of claim 9, further comprising:

a first band which binds the pipe-like portion of the fusible plug and the capillary tube together;

an adiathermanous tube provided on an outer peripheral surface of the low-pressure-side pipe; and a second band which binds the pipe-like portion of the fusible plug and the adiathermanous tube together.

* * * * *